US005472180A

United States Patent [19]

Bent

[11] Patent Number: 5,472,180

[45] Date of Patent: Dec. 5, 1995

[54] LOG HOLDER

[76] Inventor: Bertram L. Bent, Lucerne RT, Box 97A, Thermopolis, Wyo. 82443

[21] Appl. No.: 366,459

[22] Filed: Dec. 30, 1994

[51] Int. Cl.[6] ..... B25H 1/06

[52] U.S. Cl. ..... 269/99; 269/254 CS; 269/296; 269/902

[58] Field of Search ..... 269/296, 99, 902, 269/289 R, 287, 254 CS; 182/181, 182; 248/219.2; 144/4

[56] References Cited

U.S. PATENT DOCUMENTS

| | | | |
|---|---|---|---|
| 1,305,321 | 6/1919 | Tooker | 269/99 |
| 4,641,822 | 2/1987 | Fenerty | 269/296 |
| 4,676,490 | 6/1987 | Hopkins | 269/296 |
| 4,718,652 | 1/1988 | Liebenstein | 269/296 |
| 4,949,945 | 8/1990 | Whiteley | 269/71 |
| 5,232,259 | 8/1993 | Booker | 269/901 |

*Primary Examiner*—Robert C. Watson
*Attorney, Agent, or Firm*—Risto A. Rinne, Jr.

[57] ABSTRACT

An apparatus for holding firewood and dimension lumber during cutting includes an upright member having a generally triangular shaped plate attached near one end thereof, the plate includes a plurality of steps, each of the plurality of steps having a generally V-shaped portion facing downwards that is attached thereto. The V-shaped portions engage the butt end of any diameter of a log of sufficient size that is placed on the holder and prevents the butt end from becoming dislodged. A serrated plate is attached under the triangular shaped plate that is useful for securing the butt end of small logs and of dimension lumber. A first end of a longitudinal member is attached to the upright member under the serrated plate and extends away from the upright member and is generally perpendicular with respect thereto. A generally rectangular plate having a trough at the top is attached at a second end of the longitudinal member and is useful for the cantilevered placement of logs for cutting thereon. A second longitudinal member is provided at a second end of the upright member that is adapted for placing the holder into a receiver hitch of a vehicle during use. According to a modification the second longitudinal member is eliminated and a base assembly is provided which allows placement of the holder upon the ground surface during use.

15 Claims, 1 Drawing Sheet

LOG HOLDER

BACKGROUND OF THE INVENTION

1. Field of the Invention

The present invention, in general, relates to apparatus that are used to hold logs and, more particularly, to sawbucks that hold firewood above the ground during cutting.

Various types of log holders that are useful for the cutting of fireplace and woodstove size pieces of firewood are, in general, known. However present types of log holders have various disadvantages. For example they are either heavy, cumbersome, or otherwise difficult to transport. If they are constructed so as to be easier to transport, they tend to be unstable.

Other types do not adequately secure the firewood that is being cut. For example the ends of logs can easily become dislodged off of present types of log holders during cutting. Furthermore, presently known types of log holders do not adequately secure dimension lumber that is being cut for use as firewood.

Accordingly there exists today a need for a log holder that is easy to transport, stable in use, can secure the ends of logs in place, and is able to secure dimension lumber during cutting.

2. Description of Prior Art

Log holders are, in general, known. For example, the following patents describe various types of these devices:

U.S. Pat. No. 179,917 to Hawkins, Jul. 18, 1876;

U.S. Pat. No. 691,633 to Jincks & Stanton, Jan. 21, 1902;

U.S. Pat. No. 4,362,295 to Ford, Dec. 7, 1982;

U.S. Pat. No. 4,564,178 to Steffe, Jan. 14, 1986;

U.S. Pat. No. 4,641,822 to Fenerty, Feb. 10, 1987;

U.S. Pat. No. 4,676,490 to Hopkins, Jun. 30, 1987;

U.S. Pat. No. 4,718,652 to Liebenstein Jan. 12, 1988; and

U.S. Pat. No. 5,072,918 to Campbell, Dec. 17, 1991.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a log holder that is easy to transport.

It is also an object of the invention to provide a log holder that is stable.

Another object of the invention is to provide a log holder that can be inserted into a receiver hitch.

Still another object of the invention is to provide a log holder that can be used to hold dimension lumber for cutting.

Yet another object of the invention is to provide a log holder that is inexpensive to manufacture.

Briefly, a log holder that is constructed in accordance with the principles of the present invention has an upright member having a first end and a second end. A triangular shaped plate is attached to the upright member near to the first end. The plate resembles a right triangle in shape wherein a first base leg thereof is attached to the upright member and a second base leg thereof extends away from the upright member at the first end. The plate includes a series of steps on what is the hypotenuse thereof, each of the steps includes a V-shaped member attached thereto wherein the opening of the V-shaped member points downward generally toward the second end of the upright member. Attached to the upright member immediately under the plate is an optional serrated plate. Under the serrated plate, attached to the upright member at a first end thereof is a longitudinal member which extends further away from the upright member than does any portion of the plate. A generally rectangular shaped plate is attached to the second end of the longitudinal member and it includes a generally V-shaped trough at the top for holding and centering a log therein. A log is placed so that the butt end of the log is engaged by the particular V-shaped member that is disposed above and away from the longitudinal member by an amount that is greater than the diameter of the log. A portion of the log is placed so that a portion thereto rests in the trough. The remaining portion of the log which extends past the trough is cantilevered therefrom and the weight thereof keeps the butt end of the log in position bearing up and against the particular V-shaped member which it engages. According to a first embodiment, a second longitudinal member is attached to the second end of the upright member and extends away from the upright member in a direction that is generally opposite that of the longitudinal member. The second longitudinal member is adapted for insertion into a receiver hitch. According to a second embodiment, a base assembly is provided that is attached to the upright member as desired and which supports the longitudinal member above the ground surface upon which the base assembly is placed. A spring loaded assembly is provided, when desired, to better secure firewood to either described embodiment of the log holder.

DETAILED DESCRIPTION OF THE INVENTION

Figure 1:
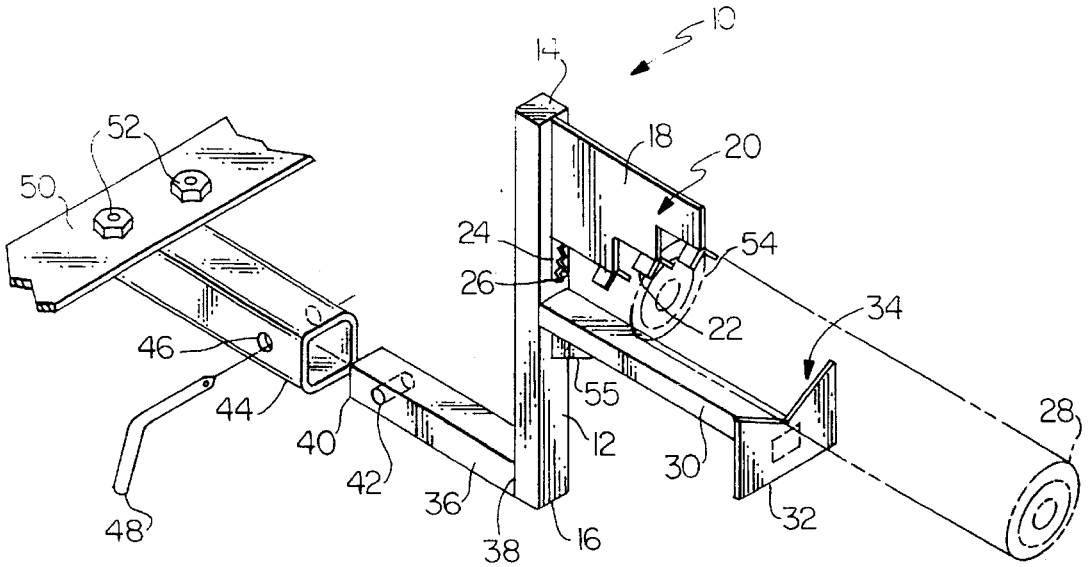
FIG. 1 is a view in perspective of a log holder ready for insertion into a receiver hitch of a vehicle with a log disposed thereon in dashed lines.

Referring to FIG. 1 is shown, a log holder, identified in general by the numeral 10.

An upright member 12 includes a first end 14 and a second end 16. A generally triangular shaped plate 18 is attached near to the first end 14 by any appropriate means such as by welding.

Mild steel is preferred for construction of the log holder 10, although any type of material may be used as desired. Attachment of the various component parts as described herein is accomplished as desired by either welding, bolting, or by any other preferred means of fastening.

The plate 18 is substantially shaped like a right triangle wherein a first base leg thereof is attached to the upright member 12. The second base leg thereof extends away from the first end 14 of the upright member 12. The remaining hypotenuse leg of the plate 18 includes a series of step gradations (herein referred to as a plurality of steps as identified in general by the reference numeral 20).

Attached to each of the plurality of steps 20 is a V-shaped member 22 that is disposed so as to orient the open end of the V-shaped member 22 away from the steps 20 and, generally, toward the second end 16 of the upright member 12.

Attached to the upright member 12 in parallel alignment with respect to the plate 18 is a serrated plate 24 that is generally rectangular in shape and with one edge thereof having serrated teeth 26. The serrated plate 24 does not extend from the upright member 12 further than the first of the plurality of steps 20 so as not to cause an interference when inserting a log (identified by reference numeral 28 and shown in phantom lines). The use of the log holder 10 is described in greater detail hereinbelow.

A longitudinal member 30 is disposed under the serrated plate 24 parallel thereto and is attached to the upright member 12 at a first end thereof. The longitudinal member 30 is of sufficient length so that it extends away from the upright member further than does any portion of the plate 18.

A rectangular shaped plate 32 is attached to a second end of the longitudinal member 30 perpendicular with respect to a longitudinal axis of the longitudinal member 30. The rectangular shaped plate 32 includes a generally V-shaped trough (identified in general by the reference numeral 34) that is disposed at the uppermost edge thereof. Of course the trough 34 could be concave rather than V-shaped providing it is able to secure the log 28 in place as is described hereinbelow.

A second longitudinal member 36 having a first end 38 and a second end 40 is attached at the first end 38 thereof to the upright member 12 near to the second end 16 thereof. The second longitudinal member 36 extends away from the upright member 12 in a direction that is generally opposite to that of the longitudinal member 30.

Near to the second end 40 of the second longitudinal member 36 is provided a hole 42 therein. The second longitudinal member 36 is adapted so as to be inserted into a receiver hitch (identified in general by the reference numeral 44).

The receiver hitch 44 includes a second hole 46 that aligns with the hole 42 of the second longitudinal member 36 when the second end 40 thereof is inserted into the hitch 44. Normally a pin 48 is used to secure the log holder 10 to the hitch 44 during use or during transport of the log holder 10.

Of course the log holder 10 may be separated apart from the hitch 44 and transported in the normal cargo carrying area (not shown) such as in the trunk (not shown) of a car (not shown) or in the cargo bed (not shown) of a pickup truck (not shown).

For purposes of illustration the hitch 44 is shown attached to a portion of a bumper 50 of a vehicle (not shown) by a pair of bolts 52. Of course the hitch 44 could be attached to the frame (not shown) of the vehicle as many types of hitches 44 are. The hitch 44 and the pin 48 are not normally component parts of the log holder 10 but are shown and described herein for purposes of clarity.

Accordingly as was described hereinabove, the log holder 10 is adapted for use with any vehicle having a receiver hitch 44 by adapting the size and configuration of the second end 40 of the second longitudinal member 36 as necessary to fit any type of the hitch 44 that is used.

In use the log 28 is placed so that the longitudinal axis of the log 28 aligns with the longitudinal axis of the longitudinal member 30 and so that the log 28 rests on the trough 34. The trough 34 accommodates any size diameter of the log 28 and tends to center the log 28 therein.

The distance that the longitudinal member 30 is disposed above the second longitudinal member 36 is selected so as to position the log 28 at a comfortable working height.

A butt end 54 of the log 28 is positioned so that it is under one of the plurality of the V-shaped member 22 that are attached to the steps 20. The plurality of steps 20 each serve to accommodate a different diameter of the log 28. The particular V-shaped member 22 that secures the butt end 54 of the log 28 is the one that is disposed immediately above the log 28. Therefore the distance between the V-shaped member 22 that secures the log 28 and the top surface of the longitudinal member must be greater than the diameter of the log 28.

The V-shaped member 22 serves a very important function in that it prevents the butt end 54 of the log 28 from rolling off of the log holder 10 during use. Normally a chain saw (not shown) is used to cut off a plurality of sections of firewood at any desired length from the portion of the log 28 that extends out beyond the rectangular shaped plate 32.

During use the chain saw exerts a force upon the log 28 as it cuts it that tends to both skew and rotate the log 28. Without the use of the V-shaped members 22 to hold the log in place, there is great tendency for the butt end 54 to become dislodged off of the log holder 10. As such the V-shaped members 22 greatly improve the functioning of the log holder 10 by maintaining the butt section 54 in position during use.

Also shown is a gusset member 55 that is attached intermediate the longitudinal member 30 and the upright member 12. The gusset 55 is an optional component that provides additional strength to the longitudinal member for supporting the weight of the log 28.

The serrated plate 24 is useful to secure dimension lumber (not shown) or an especially small log (not shown) for cutting that is too small to be held even by the lowest of the V-shaped members 22. The butt end of a small log or a piece of dimension lumber is forced into the serrated teeth 26 of the serrated plate 24. The serrated teeth 26 secures the butt end of the dimension lumber or of the small log in place during cutting.

Figure 2:
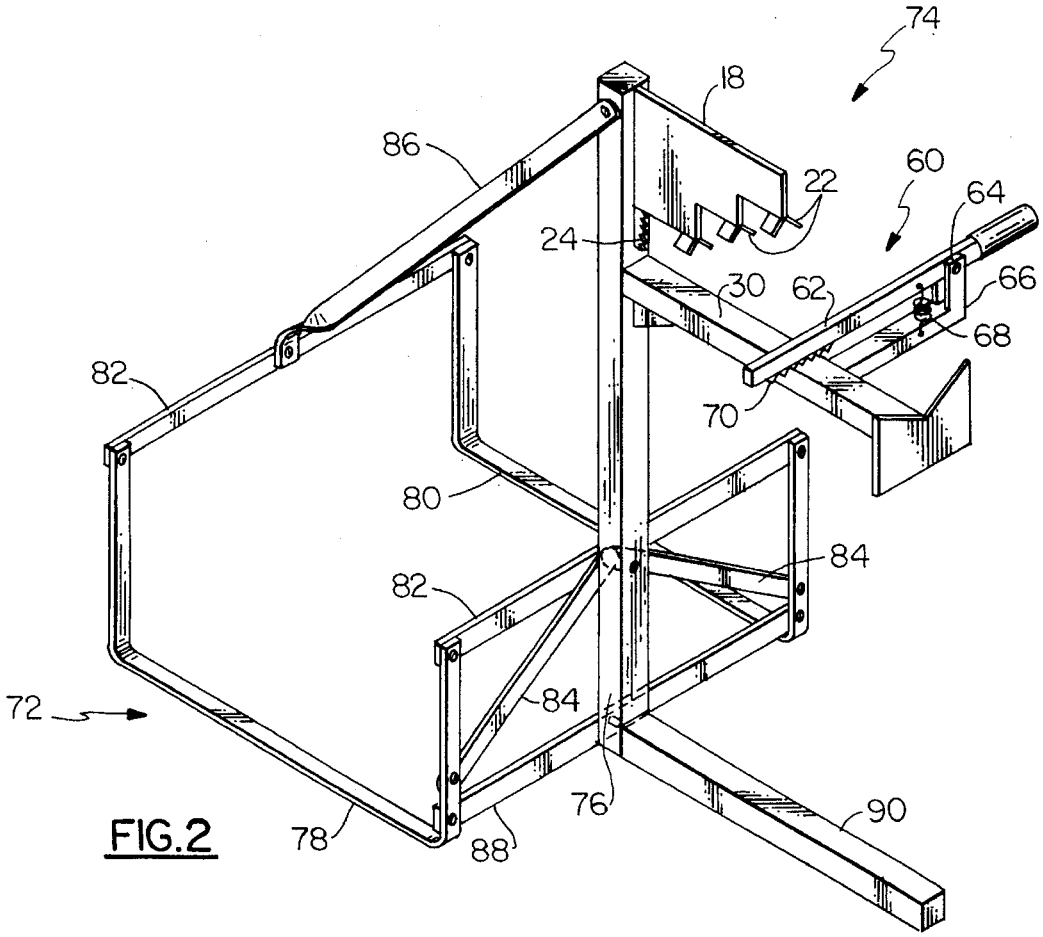
FIG. 2 is a view in perspective of a second embodiment of the log holder showing a base assembly attached thereto for supporting the holder a predetermined distance above the ground surface and a spring loaded assembly for securing firewood thereto.

On occasion additional support for the log 28 (or dimension lumber) is required. Referring now to FIG. 2, a spring loaded assembly, identified in general by the reference numeral 60 is shown attached to the longitudinal member 30 near to the rectangular shaped plate 32.

The spring loaded assembly 60 includes a cross bar 62 that is attached at a pivot axis 64 to a mounting bracket 66. The mounting bracket 66 is attached to the bottom of the longitudinal member 30 by bolts (not shown). A tension spring 68 is disposed between the mounting bracket 66 and the cross bar 62 where each end of the spring 68 is respectively attached.

A serrated portion 70 is attached to the cross bar 62 approximately where the cross bar 62 passes over the longitudinal member 30. The cross bar 62 is pulled toward the longitudinal member 30 by the spring 68. The serrated portion 70 of the cross bar 62 tends to better secure the log 28 or the dimension lumber that is placed on the holder 10. Accordingly the spring loaded assembly 60 is especially useful to hold small pieces, and in particular, dimension lumber on the log holder 10 during cutting.

The embodiment as shown in FIG. 2, relies upon a base assembly, identified in general by the reference numeral 72.

The base assembly 72 rests directly upon the ground surface (not shown) and allows the use of a modified log holder (identified in general by the reference numeral 74) when the receiver hitch 44 is not available for use.

The base assembly 72 includes a longer modified upright member 76, the bottom of which rests upon the ground and which includes a plurality of holes drilled therein useful for attaching the various component parts of the base assembly 72 thereto by a plurality of bolts, (only some of which are shown). The base assembly 72 is generally disposed on the side opposite of the modified upright member 76 with respect to the longitudinal member 30.

A first U-shaped member 78 is disposed on one side of the modified upright member 76 and a second U-shaped member 80 is similarly disposed on the opposite side of the modified upright member 76. A pair of connecting members 82 attach the tops of both of the first and second U-shaped members 78, 80 together. The connecting member 82 that is closest to the modified upright member 76 also serves to attach the first and second U-shaped members 78, 80 to the modified upright member 76.

A pair of diagonal members 84 are each attached at one end thereof to the modified upright member 76 at the same location as where the connecting member 82 that is closest to the modified upright member 76 is attached. The remaining ends of the pair of diagonal members 84 are each attached near the bottom of both the first and the second of the U-shaped members 78, 80 and as such provide the normal strength that is derived by mechanical triangulation techniques of construction.

A rear support member 86 is attached at one end to the center of the connecting member 82 that is disposed furthest from the modified upright member 76 and it is attached at the remaining end thereof near to top of the modified upright member 76.

A bottom cross member 88 is attached in the center thereof to the bottom of the modified upright member 76 and also to each of the first and second U-shaped members 78, 80. A forward member 90 is attached as desired to the bottom of the modified upright member 76 on the same side thereof as is the longitudinal member 30. The forward member 90 rests on the ground surface and provides additional stability for the modified log holder 74.

The base assembly 72 structure as described provides many advantages. There is intentional duplication of many of the parts and as such allows for more efficient and less expensive manufacture. The base assembly 72 is lightweight and can easily transported either assembled or broken down into its component parts and then assembled at the location where the modified log holder 74 will be used.

The first and second U-shaped members 78, 80 provide an area where additional logs (not shown) may be placed to provide additional weight to better secure the modified holder 74 in place and to resist the torque that occurs when the log 28 (not shown in FIG. 2) is placed on the modified holder 74 during cutting. (When the log holder 10 is inserted into the hitch 44, the entire weight of the vehicle is available to counteract this torque. )

The ability to add the additional logs on top of the first and second U-shaped members 78, 80 provides for a very light weight modified log holder 74 that functions during cutting as if it were in fact a much heavier device. Of course the base assembly 72 can be modified in other ways, for example by adding additional members (not shown) as desired to further improve strength and performance during commercial or heavy duty cutting applications.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A log holder, comprising:

(a) an upright member having a first end and a second end;

(b) a generally triangular shaped plate attached at a first side thereof to the upright member and having a second side extending away from the upright member at said first end, and having a third side disposed intermediate said first side and said second side, said third side including a plurality of steps, each of said steps including a first side that is substantially parallel with respect to said upright member and a second side that is substantially perpendicular with respect to said upright member;

(c) a generally V-shaped member attached to said second side of each of said steps wherein said V-shaped member is disposed so as to orient the open end thereof in a direction that is toward the second end of said upright member;

(d) a longitudinal member having a first end and a second end attached at the first end thereof to said upright member at a location that is disposed under said triangular shaped plate and having the second end thereof extending from said upright member in generally parallel alignment with respect to said triangular shaped plate and perpendicular with respect to said upright member and extending further from said upright member than said triangular plate; and (e) a generally rectangular shaped plate attached at said second end of said longitudinal member and including means adapted for supporting a log placed thereon.

2. The log holder of claim 1 including a second longitudinal member attached at a first end thereof to said second end of said upright member and disposed perpendicular with respect thereto extending in a direction that is generally opposite to that of said longitudinal member and having a second end thereof that is adapted for insertion into a receiver hitch.

3. The log holder of claim 1 including a base assembly attached to said second end of said upright member that is adapted for placement upon a surface and for support of said upright member perpendicular with respect to said surface.

4. The log holder of claim 3 wherein said base assembly includes two generally U-shaped members adapted for supporting a weight thereon.

5. The log holder of claim 4 wherein said base assembly includes a pair of diagonal members, each of which is attached to each of said U-shaped members at one end thereof and is attached to said upright member at the remaining end thereof.

6. The log holder of claim 1 including a serrated plate that is attached to said upright member under said triangular shaped plate and is in substantial alignment thereto, said serrated plate including a serrated edge that is disposed furthest from said upright member and is adapted for receiving the butt end of an item to be cut.

7. The log holder of claim 6 wherein said serrated edge includes a saw tooth pattern.

8. The log holder of claim 1 wherein said V-shaped member is a segment formed from angle iron stock.

9. The log holder of claim 1 including a supporting gusset, said gusset disposed intermediate said upright member and said longitudinal member.

10. The log holder of claim 1 wherein said means adapted for supporting includes a trough that is provided generally on a side of said rectangular shaped plate that is disposed furthest above said longitudinal member.

11. The log holder of claim 10 wherein said trough is generally V-shaped.

12. The log holder of claim 10 wherein said trough is generally concave in shape.

13. The log holder of claim 1 including means for securing an item to be cut to said log holder.

14. The log holder of claim 13 wherein said means for securing includes a spring loaded assembly attached to said longitudinal member and adapted for applying a force to said item to urge said item toward said longitudinal member.

15. The log holder of claim 3 including a forward member attached at a first end thereof to said second end of said upright member, said forward member extending from said upright member in a direction generally parallel with respect to said longitudinal member and having said forward member adapted for placement upon said surface.

* * * * *